US009121254B2

(12) United States Patent
Gregory

(10) Patent No.: US 9,121,254 B2
(45) Date of Patent: Sep. 1, 2015

(54) MILLABLE BRIDGE PLUG SYSTEM

(71) Applicant: CNPC USA Corp., Houston, TX (US)

(72) Inventor: Marvin Allen Gregory, Spring, TX (US)

(73) Assignee: CNPC USA Corp., Houston, TX (US)

( * ) Notice: Subject to any disclaimer, the term of this patent is extended or adjusted under 35 U.S.C. 154(b) by 215 days.

(21) Appl. No.: 13/720,797

(22) Filed: Dec. 19, 2012

(65) Prior Publication Data

US 2014/0166283 A1 Jun. 19, 2014

(51) Int. Cl.
*E21B 33/134* (2006.01)
*E21B 33/12* (2006.01)

(52) U.S. Cl.
CPC ..... *E21B 33/134* (2013.01); *E21B 33/1204* (2013.01)

(58) Field of Classification Search
CPC . E21B 33/128; E21B 33/129; E21B 33/1208; E21B 33/1216; E21B 33/134
USPC ..... 166/138
See application file for complete search history.

(56) References Cited

U.S. PATENT DOCUMENTS

| | | | | |
|---|---|---|---|---|
| 3,526,277 | A | 9/1970 | Scott | |
| 4,862,961 | A | 9/1989 | Neff | |
| 6,796,376 | B2 | 9/2004 | Frazier | |
| 7,401,788 | B2 | 7/2008 | Williams et al. | |
| 7,743,836 | B2 * | 6/2010 | Cook et al. | 166/387 |
| 7,789,135 | B2 * | 9/2010 | Turley et al. | 166/118 |
| 7,789,136 | B2 | 9/2010 | Turley et al. | |
| 7,810,558 | B2 | 10/2010 | Shkurti et al. | |
| 8,047,280 | B2 | 11/2011 | Tran et al. | |
| 8,066,065 | B2 | 11/2011 | Buckner | |
| 2009/0056956 | A1 * | 3/2009 | Ingram | 166/387 |
| 2010/0181729 | A1 | 7/2010 | Slay et al. | |

* cited by examiner

*Primary Examiner* — Robert E Fuller

(74) *Attorney, Agent, or Firm* — Andrew W. Chu; Craft Chu PLLC

(57) ABSTRACT

A millable bridge plug system includes a mandrel, a sealing member, ring members, cone assemblies, and slip devices. The sealing member, ring members, cone assemblies and slip devices are positioned on and around the mandrel. Ring members abut against an upper end and a lower end of the sealing member. The other sides of the ring members abut against the cone assemblies, and the cone assemblies engage respective slip devices. The cone assemblies have surface interfaces contacting each of the slip devices so that pressure from the cone assemblies is exerted according to contact along the surface interfaces. Each surface interface can have a curvature or be a single radiused surface. Coordination of the surface interfaces control pressure to insure improved fixed positioning in the wellbore.

9 Claims, 4 Drawing Sheets

MILLABLE BRIDGE PLUG SYSTEM

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a downhole tool for isolating zones in a wellbore. More particularly, the present invention relates to a millable bridge plug system.

2. Description of Related Art Including Information Disclosed Under 37 CFR 1.97 and 37 CFR 1.98.

A bridge plug is a downhole tool that is lowered into a wellbore. At a particular distance through the wellbore, the bridge plug is activated. The bridge plug opens and locks to seal the bridge plug to the walls of the wellbore. The bridge plug separates the wellbore into two sides. The upper portion can be cemented and tested, separate from the sealed lower portion of the wellbore. Sometimes the bridge plugs are permanent, and they seal an entire portion of the wellbore. Other times, the bridge plugs must be removed, and still other times, the bridge plugs must be removed and retrieved. These removable bridge plugs are millable or drillable, so that a drill string can grind through the bridge plug, making remnants of the destroyed bridge plug to remain at the bottom of a wellbore or to be retrieved to the surface by drilling mud flow.

Bridge plugs generally include a mandrel, a sealing member placed around the mandrel, ring members adjacent the end of the sealing member and around the mandrel, upper and lower slip devices at opposite ends of the mandrel, and respective upper and lower cone assemblies engaged to the upper and lower slip devices. FIG. 1A shows the prior art bridge plug system 10 with a mandrel 12, sealing member 14, and upper and lower slip devices 16 and 18 shown. The bridge plug is placed in the wellbore by a setting tool on a positioning assembly, such as wireline, coiled tubing or even the drill string itself. Once in position at the correct depth and orientation, the bridge plug is activated. The setting tool holds the mandrel 12 in place, while a ramming portion of the setting tool exerts pressure on the stack, which includes the sealing member 14 and the slip devices 16 and 18. The end 22 has a cap which prevents the stack from sliding off the mandrel 12, when the ramming portion of the setting tool hits the stack. Instead, the pressure of the ramming portion compresses the stack, forcing the sealing member 14 to radially extend outward to seal against the wellbore or case and to flatten to a smaller height along the mandrel. The slip devices 16 are toothed and are distended radially outward by the stack to dig into the wellbore walls, locking the sealed configuration of the stack. The lower slip device 18 holds position by the cap at the end 22, while the upper slip device 16 lowers and locks the seal of the spread sealing member 14. When the ramming portion has compressed and locked the stack, the end 20 proximal to the setting tool on the positioning assembly is sheared, separating the bridge plug from the setting tool and the positioning assembly. FIG. 1B shows the prior art bridge plug system 10 in an activated and set state. Pressure on the lower cone assembly against the lower slip device 18 at the distal end of the mandrel causes the lower slip device 16 to open and latch against the wellbore. Continuing pressure by the ram expands the sealing member 14 against the rings to form a seal against the walls of the wellbore. Pressure on the upper cone assembly causes the upper slip device 18 to also open and latch against the wellbore, setting the seal of the sealing member.

The activation of the bridge plug requires advancement for a more efficient and stable seal in the wellbore. The ramming portion provides the force needed to form the seal on the wellbore, and this force is directed by the stack structures, the sealing member, ring members, cone assemblies, and slip devices, of the bridge plug. The interactions between these stack structures are important for efficiency and consistency of the forming the seal and locking the seal on the wellbore. The pressure is exerted directly on the sealing member by ring members in some arrangements of the stack structures. The interface between the sealing member and the ring members of the prior art has a constant taper angle between the sealing member and the ring members. The amount of pressure against the sealing member does not vary as the pressure of the positioning assembly is exerted through the ring members. The expansion of the sealing member to the wall of the wellbore is steady, yet possibly insufficient for an adequate seal. The lack of a threshold amount of pressure for setting the seal may result in a sealing member that is not expanded enough to form a good seal or extrusion of the sealing member beyond the ring members due to too much pressure. The exerted pressure on the sealing member may also be too much, causing extrusion and degradation of the seal member. There is a need for resistance to excess pressure after the seal is formed.

There is also a need for more controlled activation of the slip devices against the wellbore. The slip devices dig into the walls of the wellbore to prevent the bridge plug from slipping and to set the seal of the sealing member. The slip devices resist pressure upward and downward through the wellbore. The interface between the cone assemblies and the slip devices can result in uneven activation of the slip devices around the mandrel. One arc of the slip devices may be triggered before the entire slip device so that stresses on the cone assemblies and the slip devices are irregular and risk failure on the over-stressed portions.

Conventional materials of the millable bridge plug, like all downhole tools, must withstand the range of wellbore conditions, including high temperatures and/or high pressures. High temperatures are generally defined as downhole temperatures generally in the range of 200-450 degrees F.; and high pressures are generally defined as downhole pressures in the range of 7,500-15,000 psi. Other conditions include pH environments, generally ranging from less than 6.0 or more than 8.0. Conventional sealing elements have evolved to withstand these wellbore conditions so as to maintain effective seals and resist degradation.

Metallic components have the durability to withstand the wellbore conditions, including high temperatures and high pressures. However, these metallic components are difficult to remove. De-activating and retrieving the bridge plug to the surface is costly and complicated. Milling metallic components takes time, and there is a substantial risk of requiring multiple drilling elements due to the metallic components wearing or damaging a drilling element of a removal assembly.

Non-metallic components are substituted for metallic components as often as possible to avoid having so much metal to be milled for removal of the bridge plug. However, these non-metallic components still must effectively seal an annulus at high temperatures and high pressures. Composite materials are known to be used to make non-metallic components of the bridge plug. These composite materials combine constituent materials to form a composite material with physical properties of each composite material. For example, a polymer or epoxy can be reinforced by a continuous fiber such as glass, carbon, or aramid. The polymer is easily millable and withstands the wellbore conditions, while the fibers also withstand the wellbore conditions and resist degradation. Resin-coated glass is another known composite material with downhole tool applications. Composite materials have different constituent materials and different ways of combining constituent materials.

It is an object of the present invention to provide an embodiment of the millable bridge plug system.

It is another object of the present invention to provide an embodiment of the millable bridge plug system with improved stack structures, including cone assemblies.

It is another object of the present invention to provide an embodiment of the millable bridge plug system with improved cone assemblies.

It is still another object of the present invention to provide an embodiment of the millable bridge plug system with cone assemblies with an active interface with respective slip devices.

These and other objectives and advantages of the present invention will become apparent from a reading of the attached specifications and appended claims.

SUMMARY OF THE INVENTION

A millable bridge plug system comprises a mandrel, a sealing means positioned around the mandrel, a plurality of ring members, a plurality of cone assemblies, and a plurality of slip devices. The sealing means has an upper end and a lower end. A first ring member is placed adjacent the upper end of the sealing means, and a second ring member is adjacent the lower end of the sealing means. A first cone assembly is proximate to the first ring member, and a second cone assembly is proximate to the second ring member. The slip means extend radially outward and engage an inner surface of a surrounding borehole to lock the position of the bridge plug. A first slip means is mounted around the mandrel and engages the first cone assembly, and a second slip means is mounted around the mandrel and engages the second cone assembly.

The first cone assembly further comprises a first means for exerting pressure when in contact with the first slip device, and the second cone assembly comprises a second means for exerting pressure when in contact with the second slip device. In one embodiment, the first and second means for exerting pressure are comprised of surface interfaces with curvatures. In another embodiment, the first and second means for exerting pressure are comprised of single radiused surfaces. When pressures are exerted by the cone assemblies on the first and second slip devices, the slip devices are triggered to extend radially towards the borehole at a rate dependent upon location of the pressures on the curvatures of the surface interfaces or the single radiused surfaces. The pressures on the slip devices can be tangential to the curvatures of the surface interfaces or the single radiused surfaces. The pressure is centered against the slip devices instead of being focused at a converging wedge point.

The method of installing a millable bridge plug system comprising the steps of: placing a bridge plug in a wellbore, the wellbore having inner walls surrounding the bridge plug, forming a seal against the inner walls by exerting pressure on the bridge plug, and fixing position of the bridge plug by exerting additional pressure on the bridge plug. The bridge plug includes a mandrel having an upper portion and a lower portion, a sealing means positioned around the mandrel, a plurality of ring members, a plurality of cone assemblies, and a plurality of slip means for extending radially outward and engaging the inner walls. The step of forming a seal involves the sealing member being compressed to radially extend outward to seal against the inner walls, the ring members pushing the sealing member to expand, the cone assemblies pushing the ring members. The step of fixing position of the bridge plug involves the cone assemblies pushing the slip means to extend radially outward to fixedly engage the inner walls. The cone assemblies can have means for exerting pressure so that the triggering of the slip devices is controlled according to the means for exerting. The means for exerting can be surface interfaces with curvatures or single radiused surfaces. The exerting pressure on the slip devices can be tangential to the curvatures or surfaces of the cone assemblies.

DETAILED DESCRIPTION OF THE DRAWINGS

Figure 1A:
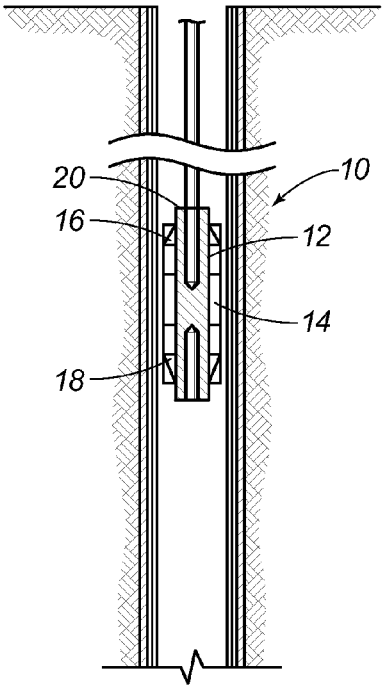
FIG. 1A Prior Art
FIG. 1A is a schematic view of a prior art bridge plug system, being placed in a wellbore.
Figure 1B:
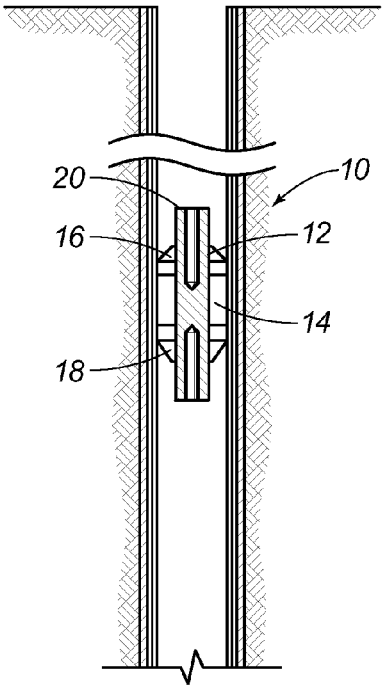
FIG. 1B Prior Art
FIG. 1B is another schematic view of the prior art bridge plug system, being locked in position within the wellbore.
Figure 2:
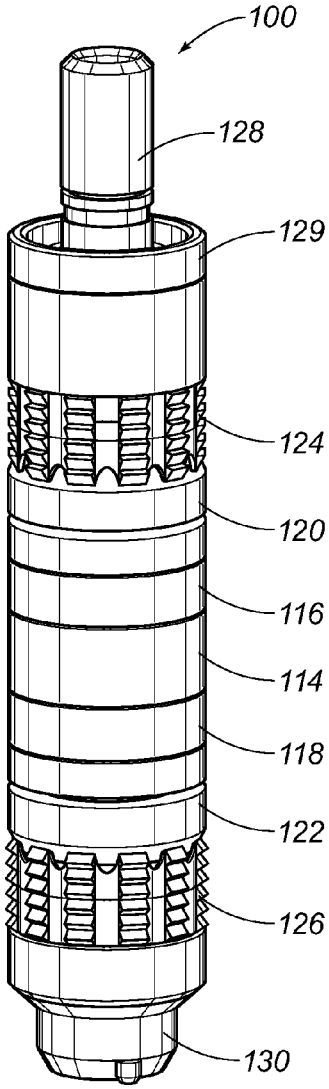
FIG. 2 is a perspective view of an embodiment of the bridge plug of the present invention.
Figure 3:
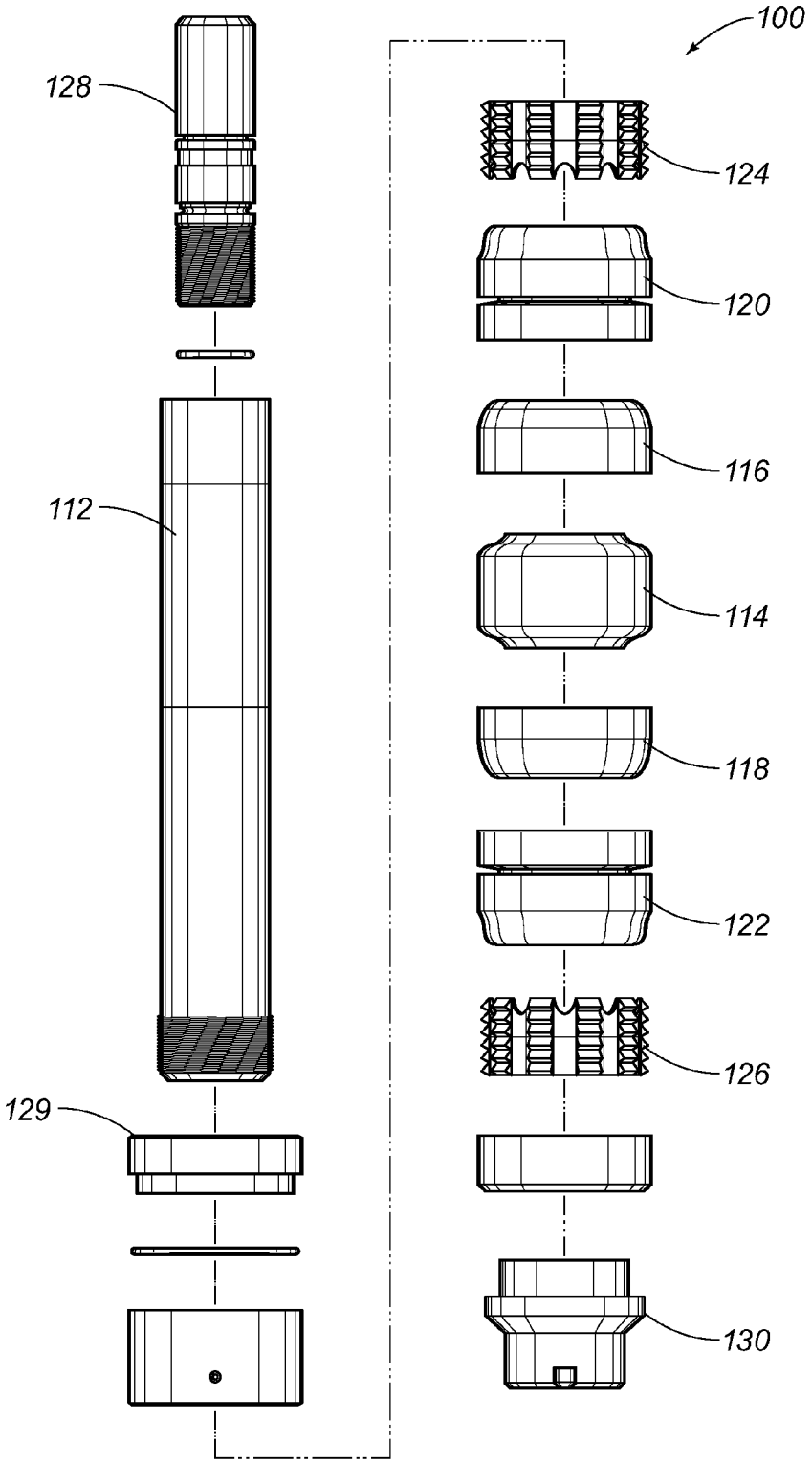
FIG. 3 is an exploded perspective view of the embodiment of FIG. 2.
Figure 4:
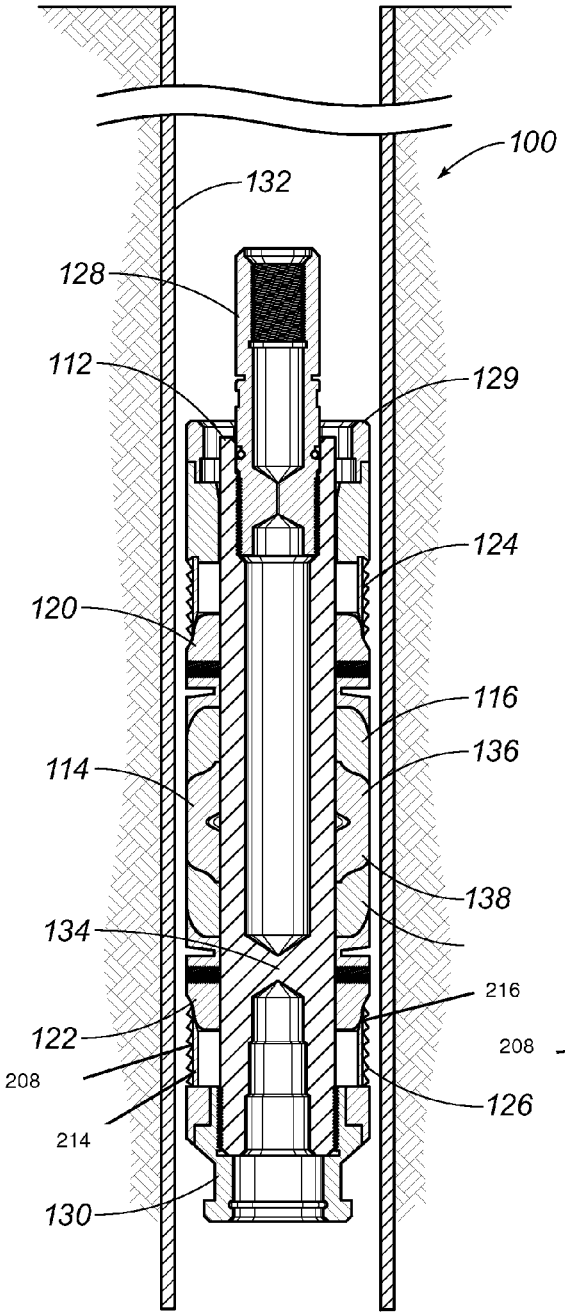
FIG. 4 is a cross-sectional view of an embodiment of the bridge plug of the present invention along an axis of the bridge plug, showing placement in the wellbore.

Referring to FIGS. 2-5, an embodiment of the millable bridge plug system 100 of the present invention is shown. The system 100 includes a mandrel 112, a sealing means 114, and a plurality of ring members, 116, 118, a plurality of cone assemblies 120, 122, and a plurality of slip means 124, 126. The sealing means 114, ring members 116, 118, cone assemblies 120, 122 and the slip means 124, 126 are stack structures mounted on the mandrel 112, sharing a common radial axis of alignment. FIGS. 2-5 also show a shearing means 128 and a cap means 130. The millable bridge plug system 100 is placed within a wellbore or borehole of a well by a setting tool. The wellbore or the borehole could have a casing or not, and the orientation of the wellbore is variable. FIG. 4 shows an embodiment with a casing 132. The bridge plug system 100 can be used in all ranges from generally vertical to generally horizontal orientations. As previously described, the millable bridge plug system 100 is used to isolate zones within the wellbore, separating sections of the wellbore for production or isolation. The system 100 is millable or drillable, such that a removal assembly, such as a drill string, can be used to grind through the system 100. All of the components of the system 100 are destroyed so that the isolated zone of the wellbore is removed.

Figure 5:
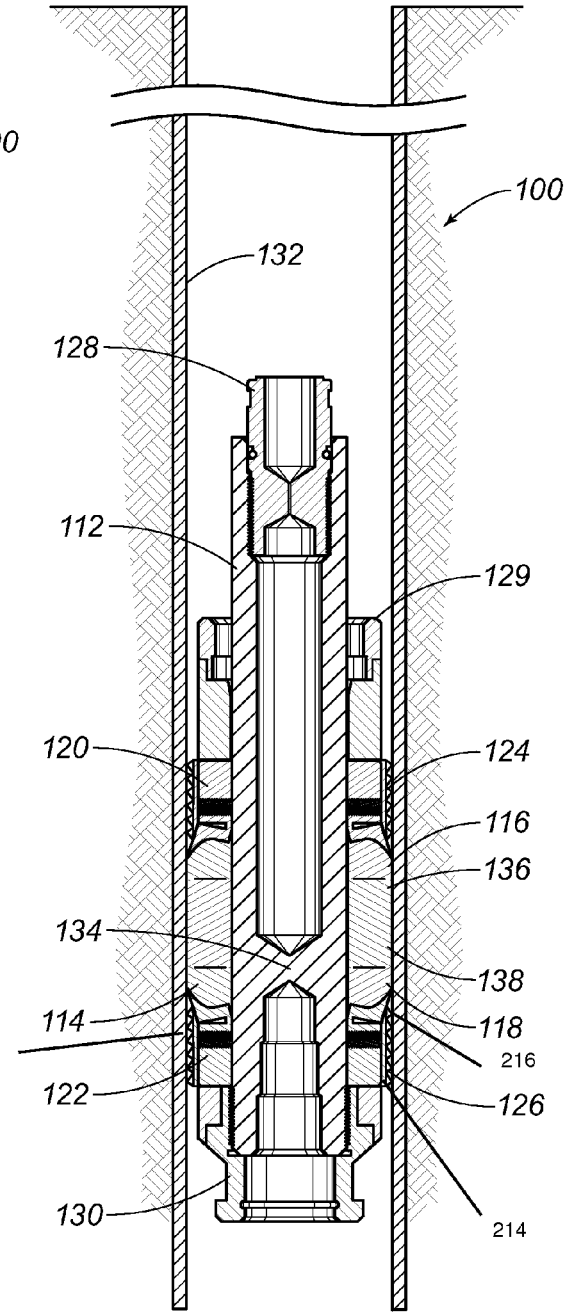
FIG. 5 is a cross-sectional view of an embodiment of the bridge plug of the present invention along an axis of the bridge plug, showing an activated configuration in the wellbore.

The mandrel 112 of the system 100 is a generally tubular member formed of a material to withstand the heat and pressure of the borehole conditions. The mandrel 112 is also millable. The mandrel 112 may have a bridge 134, which seals the zone above the system 100 from the zone below the system 100. The sealing means 114 is positioned around the mandrel 112. The sealing means 114 has an upper end 136 and lower end 138 as shown in FIGS. 4 and 5. The sealing means 114 is generally symmetrical to start and is comprised of a deformable material.

FIGS. 2-5 also show the plurality of ring members, 116, 118. There is a first ring member 116 adjacent the upper end 136 of the sealing means 114 and a second ring member 118 adjacent the lower end 138 of the sealing means 114. The ring members 116, 118 surround the sealing means 114 and surround the mandrel 112. The ring members 116, 118 contact the sealing means 114 and can exert pressure on the sealing means 114. In an activated state, the system 100 has the sealing means 114 compressed to radially extend to contact the wellbore or casing 132. The ring members 116, 118 directly contact the sealing means 114. The seal created by the sealing means 114 isolates the zones on the wellbore. In combination with the bridge 130 in the mandrel 112, the wellbore is separated.

The system 100 also includes the plurality of cone assemblies, 120, 122. FIGS. 2-5 show a first cone assembly 120 proximate to the first ring member 116 and a second cone assembly 122 proximate to the second ring member 118. As shown in exploded view of FIG. 3, the first ring member 116 is mounted on the mandrel 112 between the first cone assembly 120 and the sealing means 114. Similarly, the second ring member 118 is mounted on the mandrel 112 between the second cone assembly 122 and the sealing means 114. The cone assemblies 120, 122 contact the ring members 116, 118 and can exert pressure on the ring members 116, 18. In an activated state, the system 100 has pressure of the cone assemblies 120, 122 pushing through the ring members 116, 118 to the sealing means 114.

FIGS. 2-5 also show the plurality of slip means 124, 126 for extending radially outward and engaging an inner surface of a surrounding borehole. The slip means 124, 126 lock the position of the system 100 by fixedly engaging the casing 132 or other structure on the inner surface of the borehole. The slips dig into the casing 132 to anchor the millable bridge plug system 100. Pressure can be exerted on the system 100 to create the seal with the sealing means 114, once the slip means 124, 126 are active or while the slip means 124, 126 are being activated. There is a first slip means 124 mounted around the mandrel 112 and engaging the first cone assembly 120 and a second slip means 126 mounted around the mandrel 112 and engaging the second cone assembly 122. The present invention may include further stack structures, such as cone seats or other supplemental ring members. Embodiments of the present invention relate to the structures and interactions between particularly defined stack structures to properly control the force exerted by the setting tool during installation.

Figure 6:
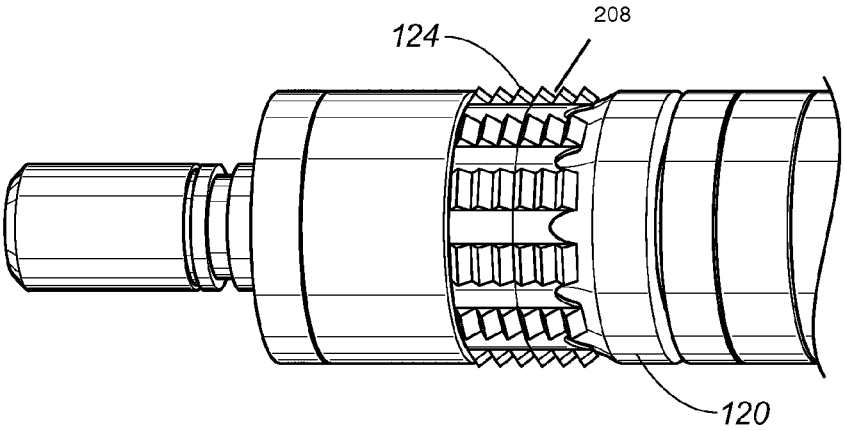
FIG. 6 is a partial perspective view of a cone assembly and a slip device of an embodiment of the bridge plug of the present invention.
Figure 7:
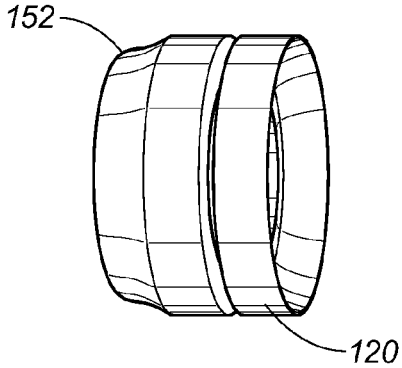
FIG. 7 is an isolated perspective view of an embodiment of the cone assembly according to FIG. 6.
Figure 8:
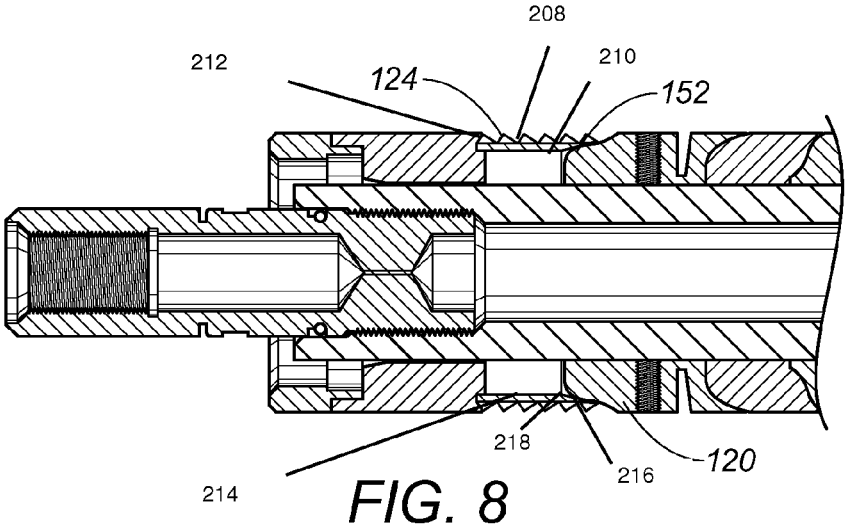
FIG. 8 is a partial cross-sectional view of the embodiments of the cone assembly and the slip device of FIG. 6.

FIGS. 6-8 shows detailed views of the first cone assembly 120 and the first slip means 124 in an embodiment of the present invention. The second cone assembly 122 and the second slip means 126 have the analogous parts and structural interrelationships. The first cone assembly 120 has a first means 152 for exerting pressure when in contact with the first slip means 124. The second cone assembly 120 and the second means for exerting pressure when in contact with the second slip means 126 is not shown, although those structures are generally identical. In one embodiment, the first means 152 for exerting pressure is comprised of a surface interface with a curvature. The pressures exerted by the cone assemblies 120, 122 on the slip means 124, 126 cause expansion of the slip devices 124, 126 related to the first means 152 and the second means of the cone assemblies 120, 122.

The rate of expansion and triggering of the lock onto the walls of the wellbore is controlled by the location of the pressures on curvatures of the surface interfaces of the cone assemblies 120, 122. The cone assemblies 120, 122 do not provide steady or even pressure on the slip means 124, 126 to expand or trigger at a constant rate. Because of the curvature, the pressure along the curvature can build until a fulcrum is reached, wherein the tangential pressure to the curvature is sufficient to start the deformation or trigger of the slip means 124, 126. Additionally, the fulcrum action centers the pressure against the slip means 124, 126 instead of the base of the slip means 124, 126. The curvature has the fulcrum pressure moves along the slip device to the middle of the slip device to snap the slip means to trigger and dig into the wellbore. There is more full extension of the slip means, and there are side breaks of the slip means instead of middle breaks. The present invention reduces the risk of insufficient pressure to deform the slip means 124, 126 or partial triggering of the slip means.

In prior art systems, the amount of pressure may be a gradual conical taper without variation or control. The control of the pressure on the slip means 124, 126 cannot be controlled because the converging taper is constant. Also, the converging shape focuses the pressure at the base of the slip device and at the tip of the wedge shape. This pressure at the base will not evenly snap the slip means for a middle break and use of all of the teeth on the slip means. In the present invention, a threshold of pressure at the fulcrum on the curvature of the present invention improves this trigger of the slip devices to radially extend and lock with all teeth against the wellbore. The pressure is centered on the slip means, instead of pinched at the base, and the fulcrum point sets a consistent trigger.

FIGS. 6-8 show one embodiment of the first means 152 as a single radiused surface. The shape of the single radiused surface similarly creates the fulcrum along the curvature of the other embodiment. The single radiused surface similarly controls the deformation and trigger of the slip devices 124, 126. Each slip device 124, 126 is comprised of an outer surface 208 with teeth 212 pointed outward from the mandrel 112 and an inner surface 210 with a tapered portion 216 and a planar portion 214. Each slip device 124, 126 has an attached position in FIG. 4 and a deployed position in FIG. 5. The teeth 212 are parallel to the planar portion 216, including the teeth on the tapered portion 214. FIG. 8 shows the connection 218 between the tapered portion 214 and the planar portion 216 of each slip device 124, 126.

A positioning assembly with a setting tool places the system 100 within the wellbore. The slip means 124, 126 fix the bridge plug system 100 within the wellbore. The setting tool of the positioning assembly exerts pressure so that the cone assemblies 120, 122 push the slip means 124, 126 to extend radially outward to fixedly engage the inner walls. Additionally, pressure causes the seal to form, and further pressure moves and locks both of the slip means 124, 126 in place. The position is fixed, and the seal is locked. The sealing means 114 will not contract away from the inner walls of the wellbore. The pressure of the first means 152 for exerting pressure is tangential against the first slip means 124. The first means 152 for exerting pressure has a curvature so that the contact on the first slip means 124 is variable, depending upon the location along the curvature. In one embodiment, the curvatures are single radiused surfaces, and the pressure exerted by the cone assemblies 120, 122 remain tangential to the single radiused surfaces against the slip means 124, 126.

The present invention provides an embodiment of the millable bridge plug system with innovative cone assemblies. The slip means have a controlled expansion or trigger to fix the position of the system and to set the seal under more known and predictable conditions, resulting in a more consistent and stronger seal. The pressure exerted on the millable bridge plug is more regulated by active surface interfaces and curvatures of the cone assemblies, including a single radiused surface in one embodiment. There is improved control of the expansion and trigger to fix the system and set the seal.

The foregoing disclosure and description of the invention is illustrative and explanatory thereof. Various changes in the details of the illustrated structures, construction and method can be made without departing from the true spirit of the invention.

I claim:

1. A millable bridge plug system comprising:

a mandrel having an upper portion and a lower portion and being positioned in a wellbore;

a means for sealing against inner walls of said wellbore, the sealing means being positioned around the mandrel;

a plurality of ring members; comprising a first ring member adjacent an upper end of said sealing means and a second ring member adjacent a lower end of said sealing means;

a plurality of cone assemblies, a first cone assembly proximate to said first ring member and a second cone assembly proximate to said second ring member, said first ring member being between said first cone assembly and said sealing means, said second ring member being between said second cone assembly and said sealing means; and a plurality of slip means for extending radially outward and engaging said inner walls of said wellbore, a first slip means mounted around said mandrel and engaging said first cone assembly and a second slip means mounted around said mandrel and engaging said second cone assembly, wherein each slip means is comprised of an outer surface with teeth pointed outward from said mandrel and an inner surface with a tapered portion and a planar portion, each slip means having an attached position and a deployed position, said teeth being parallel to said planar portion, wherein said first cone assembly has a single radiused surface in contact with said first slip means at a first connection between said tapered portion and said planar portion of said first slip means, and wherein said second cone assembly has a single radiused surface in contact with said second slip means at a second connection between said tapered portion and said planar portion of said second slip means, wherein said first cone assembly fits within said first slip means, and wherein said second cone assembly fits within said second slip means, wherein pressure of said single radiused surface of said first cone assembly against said first slip means extends said first slip means radially outward from said attached position to said deployed position, when pressures perpendicular to the single radiused surfaces of the first cone assembly are exerted on the first connection between the tapered portion and the planar portion of the first slip means, and wherein pressure of said single radiused surface of said second cone assembly against said second slip means extends said second slip means radially outward from said attached position to said deployed position, when pressures perpendicular to the single radiused surfaces of the first cone assembly are exerted on the first connection between the tapered portion and the planar portion of the first slip means.

2. A method of installing a millable bridge plug system, comprising the steps of:

placing a bridge plug in a wellbore, said wellbore having inner walls surrounding said bridge plug, said bridge plug comprising:

a mandrel having an upper portion and a lower portion;

a sealing means positioned around the mandrel;

a plurality of ring members comprising a first ring member adjacent an upper end of said sealing means and a second ring member adjacent a lower end of said sealing means;

a plurality of cone assemblies, a first cone assembly proximate to said first ring member and a second cone assembly proximate to said second ring member, said first ring member being between said first cone assembly and said sealing means, said second ring member being between said second cone assembly and said sealing means; and a plurality of slip means for extending radially outward and engaging an inner surface of a surrounding borehole, a first slip means mounted around said mandrel and engaging said first cone assembly and a second slip means mounted around said mandrel and engaging said second cone assembly, wherein said first cone assembly has a first means for exerting pressure when in contact with said first slip means, wherein said second cone assembly has a second means for exerting pressure when in contact with said second slip means, wherein said first means for exerting pressure comprises a first curvature, wherein said second means for exerting pressure comprises a second curvature, wherein each slip means is comprised of an outer surface with teeth pointed outward from said mandrel and an inner surface with a tapered portion and a planar portion, each slip means having an attached position and a deployed position, said teeth being parallel to said planar portion;

forming a seal within said wellbore with said bridge plug; and locking said seal within said wellbore when said first slip means extends radially outward from said attached position to said deployed position, wherein pressures perpendicular to the first means for exerting pressure are exerted on a first connection between the tapered portion and the planar portion of the first slip means, and wherein pressures perpendicular to the second means for exerting pressure are exerted on a second connection between said tapered portion and said planar portion of said second slip means, wherein the step of forming a seal comprises:

compressing said sealing member to radially extend outward to seal against said inner walls, said ring members pushing said sealing member to expand, said cone assemblies pushing said ring members, wherein the step of fixing said bridge plug comprises:

exerting pressure on said bridge plug with a setting tool of a positioning assembly, and wherein each curvature of each means for exerting pressure of each cone assembly engages each respective ring member as a single radiused surface.

3. The method of installing the bridge plug system, according to claim 2, the step of fixing said bridge plug comprises:

exerting pressure on said bridge plug with a setting tool of a positioning assembly.

4. The method of installing the bridge plug system, according to claim 3, said cone assemblies pushing the first and second slip means to extend radially outward to fixedly engage said inner walls in respective deployed positions, said bridge plug being locked in position within said wellbore, wherein pressure perpendicular to the first and second means for exerting pressure and against respective tapered portions of the first and second slip means increases.

5. The method of installing the bridge plug system, according to claim 4, wherein each slip assembly moves from said attached position to said deployed position, when said pressures are perpendicular to respective curvatures.

6. The method of installing the bridge plug system, according to claim 5, wherein pressure is perpendicular to the curvatures and increases along the curvatures of the first and second means for exerting pressure against respective tapered portions of the first and second slip means.

7. The method of installing the bridge plug system, according to claim 6, wherein said first curvature is a first single radiused surface, and wherein said second curvature is a second single radiused surface.

8. The method of installing the bridge plug system, according to claim 2, wherein said first curvature is a first single radiused surface, wherein said second curvature is a second single radiused surface, wherein pressures are exerted by said cone assemblies on said slip means, and wherein extension of said slip means from said attached position to said deployed position is dependent upon location of said pressures on the first and second single radiused surfaces of said cone assemblies in relation to the first and second connection points of the respective slip means.

9. The method of installing the bridge plug system, according to claim 8, wherein said pressures on said slip means by said cone assemblies are perpendicular to the first and second single radiused surfaces.

* * * * *